United States Patent [19]

Shaffer et al.

[11] Patent Number: 4,822,316

[45] Date of Patent: Apr. 18, 1989

[54] TOY VEHICLE

[75] Inventors: Ralph E. Shaffer, Columbia Station; Edward G. Chanter, Lakewood; Randy j. Randleman, Cleveland; Robert H. Yeager, Parma Heights, all of Ohio

[73] Assignee: Those Characters From Cleveland, Inc., Independence, Ohio

[21] Appl. No.: 59,633

[22] Filed: Jun. 8, 1987

[51] Int. Cl.[4] ..... A63H 17/26; A63H 17/267

[52] U.S. Cl. ..... 446/466

[58] Field of Search ..... 446/466, 469, 465, 431, 446/94, 95, 55, 291; 403/96, 97; 180/209; 280/43.12, 43.16, 43.17, 43.23, 43.24, 43

[56] References Cited

U.S. PATENT DOCUMENTS

| | | | |
|---|---|---|---|
| 3,277,601 | 10/1966 | Ryan . | |
| 4,186,905 | 2/1980 | Brudy | 403/97 X |
| 4,248,006 | 2/1981 | Jones et al. . | |
| 4,392,541 | 7/1983 | Barchard | 280/43.12 X |
| 4,602,800 | 7/1986 | Persson | 180/209 X |

FOREIGN PATENT DOCUMENTS

| | | |
|---|---|---|
| 109329 | 3/1925 | Switzerland . |

OTHER PUBLICATIONS

"Battlecrane", Starcom Toy by Coleco Industries, Inc., N.Y. ©1986.

"Shadow Invader", Starcom Toy by Coleco Industries, Inc., N.Y. ©1986.

"Shadow Raider", Starcom Toy by Coleco Industries, Inc. N.Y. ©1986.

"Super Stretch" by Illco, 1986.

*Primary Examiner*—Mickey Yu

*Attorney, Agent, or Firm*—Calfee, Halter & Griswold

[57] ABSTRACT

A toy vehicle with a joint structure supporting the wheels of the toy vehicle in a manner that enables the vehicle and its wheels to be placed in a variety of unique and attractive orientations. The toy vehicle has a chassis and at least three wheels connected with the chassis by means of the joint structure. The joint structure enables each wheel to be independently adjusted relative to the chassis to selectively adjust the relative orientation of the chassis and one or more of the wheels. The joint structure can be adjusted by a manually applied torque, but when the joint structure is in an adjusted position, it can maintain its adjusted position under gravitational-/inertial forces applied to it by the toy vehicle. Thus, the joint can be "adjustably retained" in selected adjusted position.

8 Claims, 3 Drawing Sheets

TOY VEHICLE

BACKGROUND AND SUMMARY OF THE INVENTION

The present invention relates to a toy vehicle with a joint structure supporting the wheels of the toy vehicle in a manner that enables the vehicle and its wheels to be placed in a variety of unique and attractive orientations.

According to one aspect of the invention, the toy vehicle has a chassis and at least three wheels connected with the chassis by means of the joint structure. The joint structure enables each wheel to be independently adjusted relative to the chassis to selectively adjust the relative orientation of the chassis and one or more of the wheels. The joint structure can be adjusted by a manually applied torque, but when the joint structure is in an adjusted position, it can maintain its adjusted position under gravitational/inertial forces applied to it by the toy vehicle. Thus, the joint structure can be "adjustably retained" in selected adjusted positions.

According to another aspect of the invention, the joint structure for each of the wheels comprises a chassis joint member and a wheel joint member. The wheel joint member rotatably supports one of the wheels and the chassis joint member connects the wheel joint member with the chassis. A portion of the chassis joint member is pivotally connected to the chassis in a manner that enables the chassis joint member to be adjustably retained in selected angular positions relative to the chassis. Another portion of the chassis joint member is pivotally connected to the wheel joint member, in a manner that enables the chassis and wheel joint members to be adjustably retained in selected angular positions relative to each other. Thus, the modes of adjustment of the wheel relative to the chassis can be varied as a complex function of the modes of adjustment of the chassis joint member relative to the chassis and the modes of adjustment of the wheel joint member relative to the chassis joint member.

An additional aspect of the toy vehicle of the present invention is the provision of joint support means and stop means connected with the chassis. The joint support means provides support for parts of the joint structure in certain of its adjusted positions, to help stabilize the vehicle in certain of its orientations. The stop means prevents the joint structure and/or the associated wheel from being placed in an orientation in which they would unbalance the toy vehicle, or otherwise interfere with the proper operation of the toy vehicle.

A still further aspect of the present invention is the construction of a toy vehicle with new and useful joint structures which are designed to minimize weight, resist wear during repeated use and which are believed to be economical and efficient to construct.

This and other features of the toy vehicle of the present invention will become further apparent from the following detailed description and the accompanying drawings.

DETAILED DESCRIPTION OF THE PREFERRED EMBODIMENT

Figure 1:
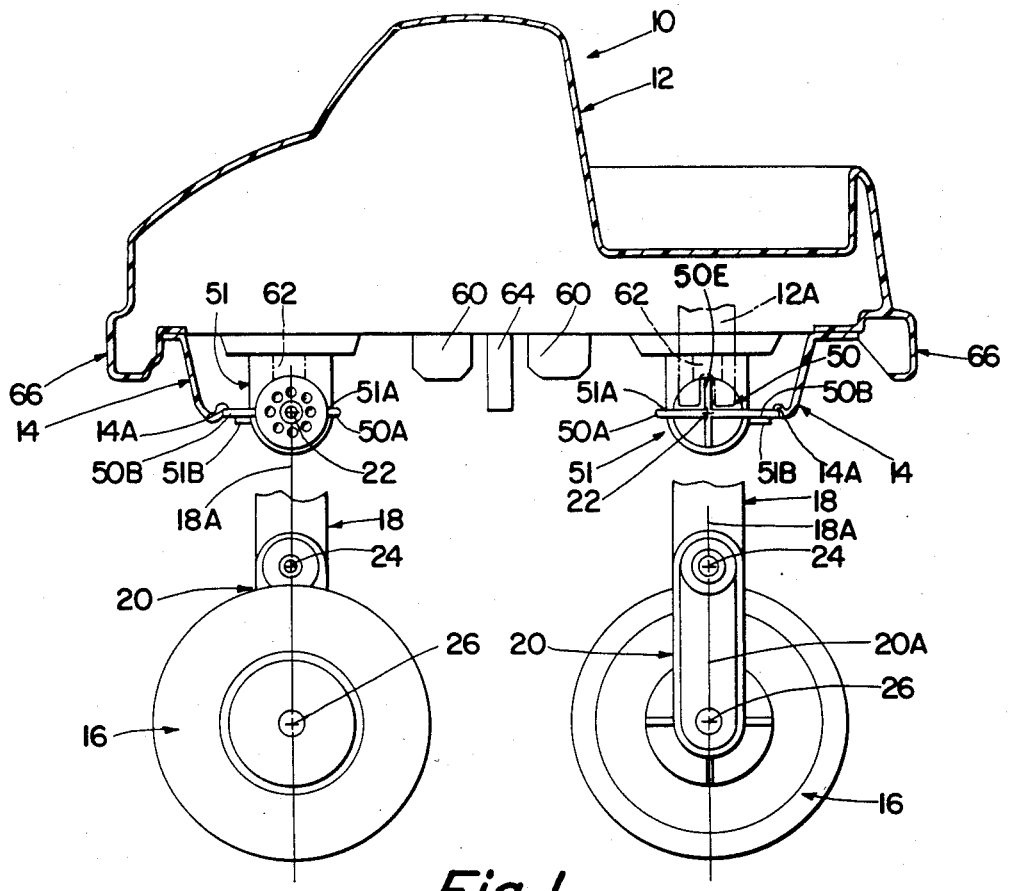
FIG. 1 is a schematic side elevational view, with portions omitted and portions shown in section, of a toy vehicle constructed according to the principles of this invention.

FIGS. 1 through 6 illustrate a toy vehicle 10 constructed according to the principles of this invention. The toy vehicle comprises a body 12, and a chassis 14 which is mechanically coupled to the body 12 by fasteners such as screws (not shown). Each of a plurality of wheels 16 are connected with the chassis, by means of the special joint structure described hereinafter. The joint structure enables the orientation of each of the wheels 16 to be independently adjusted relative to the chassis 14 in order to adjust the relative orientation of the wheels 16 and the chassis 14.

Preferably, the toy vehicle 10 includes four wheels, two front wheels and two rear wheels. Each of the wheels is connected with the chassis 14 by the joint structure described hereinafter. For ease of explanation, FIGS. 1–3 schematically illustrate one front wheel and one rear wheel.

Figure 3:
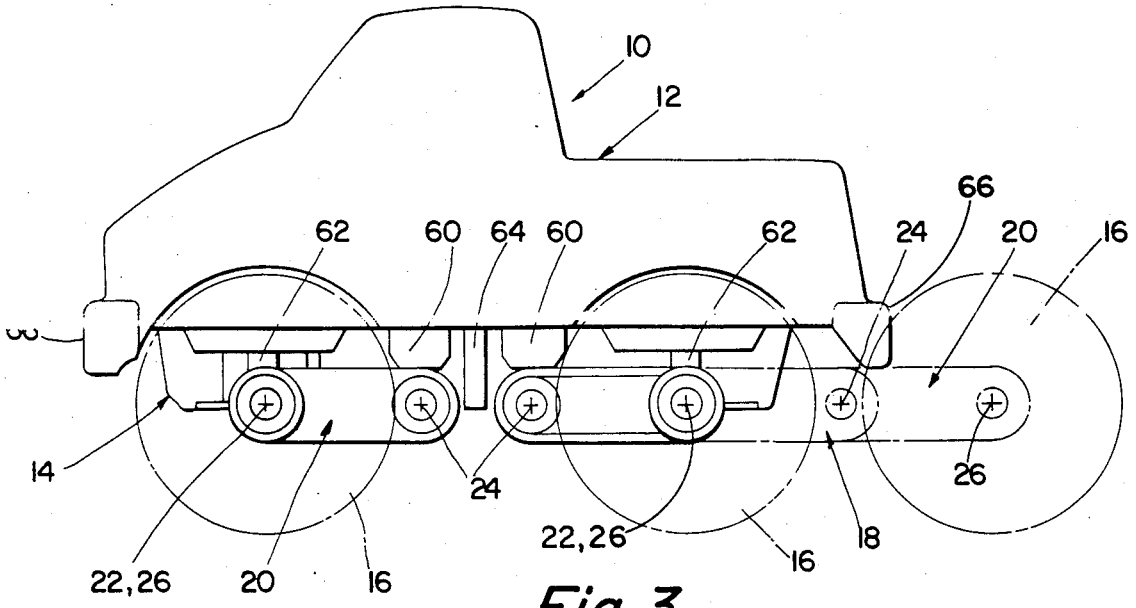
FIG. 3 is a schematic, side elevational illustration of the toy vehicle of FIG. 1, with one of the adjusted wheel positions shown in phantom.
Figure 2A:
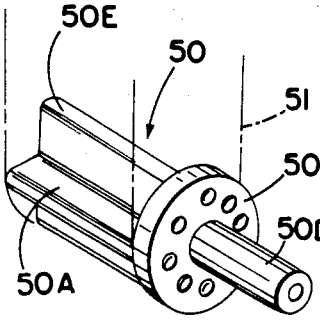
FIG. 2A is a fragmentary, three-dimensional view of a portion of a joint structure for the toy vehicle.
Figure 2:
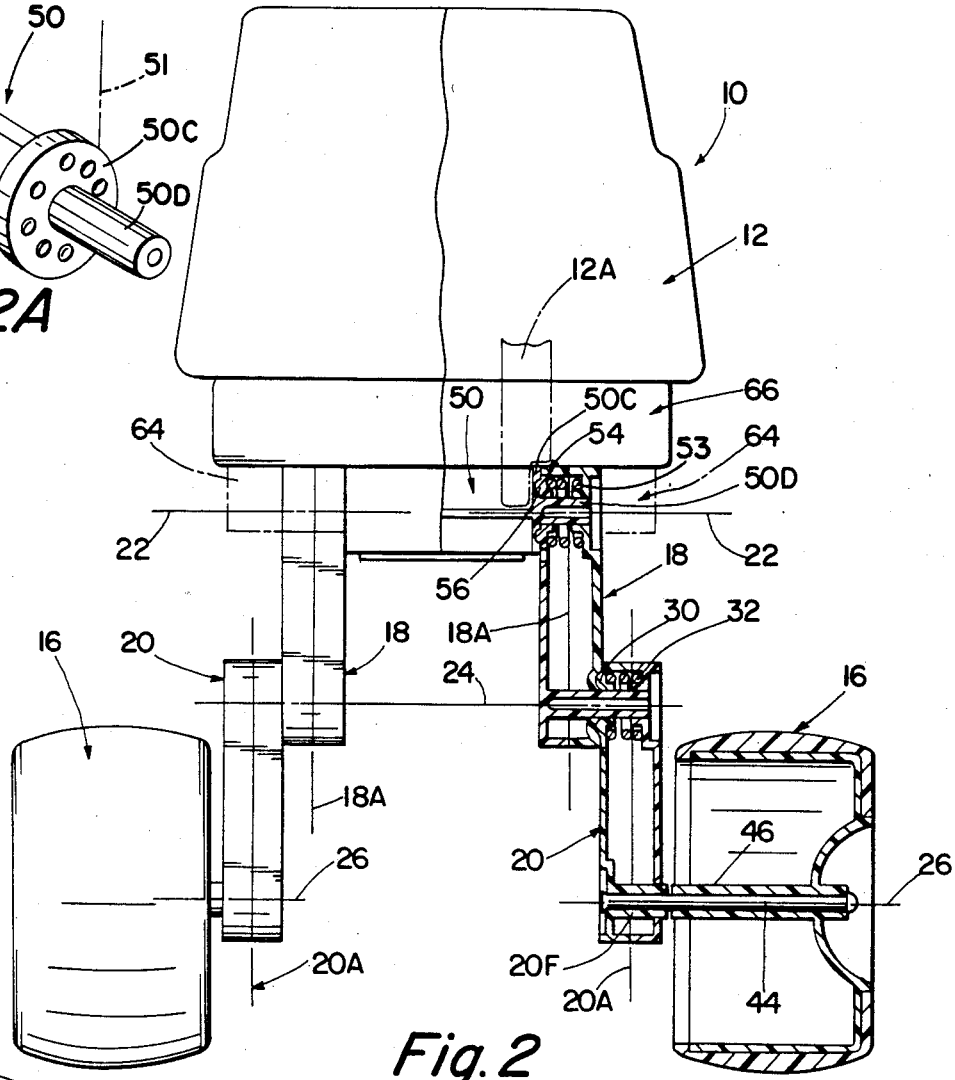
FIG. 2 is a front elevational view, with portions omitted and portions shown in section, of a toy vehicle constructed according to the principles of this invention.

As seen in FIGS. 1–3, each wheel 16 is connected with the chassis by means of two joint members 18, 20. One of the joint members 18, referred to herein as the chassis joint member, is coupled with the chassis 14. The other joint member 20, referred to herein as the wheel joint member, is coupled at one end with the wheel 16 and at the other end with the chassis joint member 20.

In the joint structure of the preferred embodiment (FIGS. 1–6), there are two important pivotal connections. One pivotal connection is between the chassis joint member 18 and the toy vehicle's chassis 14. The other pivotal connection is between the wheel joint member 20 and the chassis joint member 18.

The connection between the chassis joint member 18 and the chassis 14 enables the entire joint structure for each wheel to pivot relative to the chassis 14. Thus, one way of adjusting the orientation of a wheel relative to the chassis 14 is to adjust the angular position of the chassis joint member 18 relative to the chassis 14. The connection between the wheel joint member 20 and the chassis joint member 18 enables the wheel joint member 20 to pivot relative to the chassis joint member 18. Thus, the orientation of each wheel 16 relative to the chassis 14 can be varied as a compound function of the adjustment of the chassis joint member 18 relative to the chassis 14, and the further adjustment of the wheel joint member 20 relative to the chassis joint member 18. For example, it is possible to adjust the joint structures of the wheels to place the chassis 14 and the wheels 16 in the orientations shown in FIGS. 8 and 9, as well as numerous other orientations. In fact, it is believed that in a toy vehicle according to the present invention, there are approximately 52 different independent wheel adjustments relative to the chassis. The independent wheel adjustments, alone or in combination with the support structure described hereinafter, enable the chassis 14 and the wheels 16 to assume numerous stable orientations relative to each other.

As seen in FIGS. 1–6, the wheel joint member 20 and the chassis joint member 18 associated with each wheel 16 are longitudinally extending members with longitudinal central axes 20A, 18A which are parallel to each other. The chassis joint member 18 can pivot about a pivot axis 22 which is fixed with respect to the chassis 14, and which extends perpendicular to the longitudinal axis 18A of the chassis joint member. The wheel joint member 20 and the chassis joint member 18 can pivot relative to each other about a pivot axis 24 which extends parallel to the pivot axis 2 and perpendicular to the longitudinal axes 18A, 20A. Also, the wheel joint member 20 supports its associated wheel 16 for rotation about an axis 26 extending parallel to the pivot axes 22, 24 and perpendicular to the longitudinal axes 18A, 20A of the chassis and wheel joint members 18, 20.

The pivotal connections between the chassis joint member 18 and the chassis 14, and between the wheel joint member 20 and the chassis joint member 18 are designed to allow the joint members to be adjustably retained in discrete angular positions relative to each other. The concept of being "adjustably retained" in discrete angular positions, as used herein, is intended to mean joint members which are biased so as to be retained in a selected angular orientation under gravitational/inertial forces applied by the toy vehicle, but which can be pivoted to another selected angular orientation when subjected to a torque that overcomes the bias. Preferably, the joint is designed so that the torque for overcoming the bias on the joint members can be produced by manual turning of the joint members about the pivot axes 22 and/or 24, thereby to enable the orientation of the joint members relative to the chassis 14 to be adjusted by hand, but to be otherwise retained in a selected adjusted position.

Figure 4:
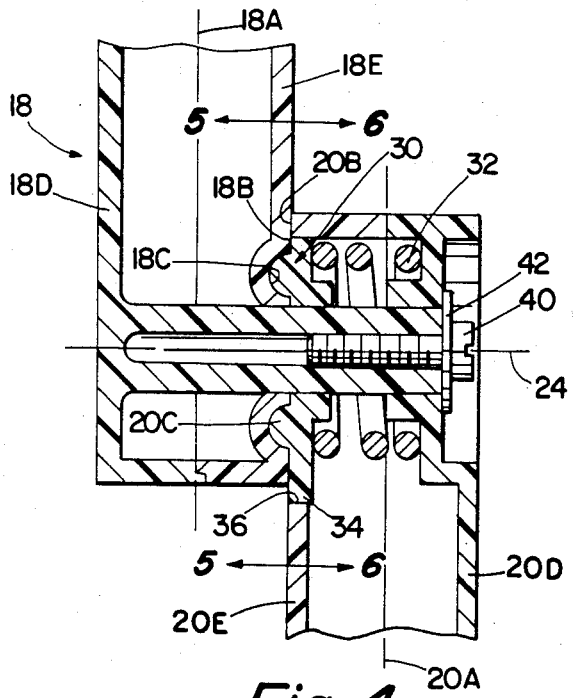
FIG. 4 is a sectional view, on an enlarged scale, of a portion of the joint structure in the toy vehicle of FIG. 2.
Figure 5:
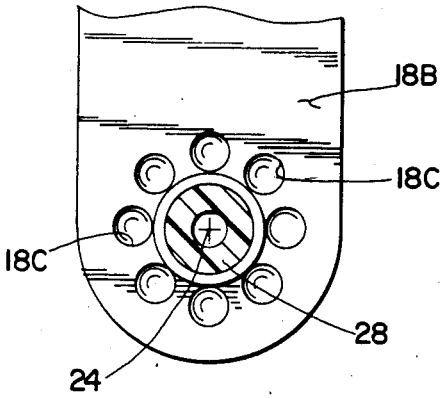
FIGS. 5 and 6 are views of the joint structure of FIG. 4, taken along the lines 5—5 and 6—6, respectively.
Figure 6:
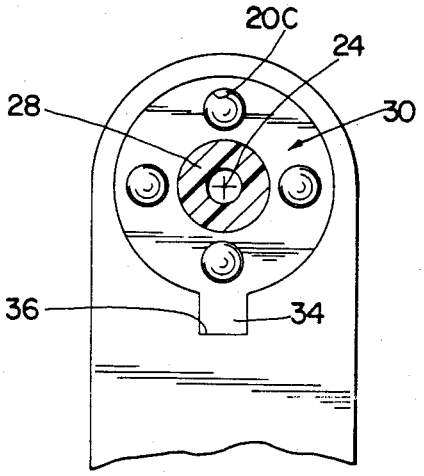

FIGS. 4-6 illustrate the specific construction of the joint structure connecting the chassis joint member 18 and the wheel joint member 20. In the joint structure of FIGS. 4–6, the chassis joint member 18 includes a screw boss 28 extending normal to the longitudinal axis 18A of the chassis joint member 18. The screw boss 28 has a central axis defining the pivot axis 24. The wheel joint member 20 is supported by, and is adapted to pivot about, the screw boss 28. The chassis joint member 18 and the wheel joint member 20 have juxtaposed facing surfaces 18B, 20B, respectively. The surface 18B of the chassis joint member 18 includes a series of recesses 18C equally spaced about the pivot axis 24 defined by the screw boss 28. The surface 20B of the wheel joint member 20 includes a series of detent members 20C equally spaced about the pivot axis 24 defined by the screw boss 28. As seen in FIGS. 4–6, there are four detent members 20C in the surface 20B of the wheel joint member 20, and there are eight recesses 18C in the surface of the chassis joint member 18. The detent members and the recesses are equally spaced about the pivot axis 24 and are spaced relative to each other so that when one detent member 20C is engaged with a recess 18C, the remaining three detent members 20C will also be engaged with respective recesses 18C.

The detent members 20C are preferably carried on a detent pad 30 which encircles the screw boss 28 and which can move axially relative to the screw boss 28. A metal helical spring 32 resiliently biases the detent pad 30 toward the surface 18B of the chassis joint member 18. Thus, the spring 32 applies the biasing force tending to hold the detent members 20C engaged with the recesses 18C in the chassis joint member 18.

The detent pad 30 is coupled with the wheel joint member 20 by means of a key and slot connection. The detent pad 30 has a key 34 which engages a slot 36 in the wheel joint member. Thus, the detent pad 30 can move axially relative to the screw boss 28, but the detent pad 30 and the rest of the wheel joint member must rotate jointly about the screw boss 28. When the chassis and wheel joint members are assembled, a screw 40 and a washer 42 couple the wheel joint member 20 and the chassis joint member 18 together. The spring 32 urges the detent pad 30 toward the surface 18B of the chassis joint member 18 and the detent pad 30 can move axially along the screw boss 28 when the spring force is overcome.

The shape (i.e., the outer profile) of the recesses 18C and the detents 20C is designed so that a camming force is applied against the detents when a torque is applied to the joint members tending to pivot them around the axis 24 defined by the screw boss 28. The camming force tends to urge the detents 20C out of the recesses 18C. In the embodiment of FIGS. 1–6, the camming force also urges the detent pad 30 axially along the screw boss 28 against the bias of spring 32. Thus, when the torque is high enough, the force applied to the detent pad 30 will move the detent pad 30 against the bias of the spring 32, thereby enabling the wheel and chassis joint members to be pivoted about axis 24 to an adjusted angular position relative to each other.

When the joint members reach an adjusted angular position, and the torque is not sufficient to continue to overcome the spring bias, the spring 32 urges and maintains the detent pad 30 and its detents 20C into engagement with respective recesses 18C in the chassis joint member 14. Until a torque is applied to the joint members that is high enough to again overcome the spring bias the chassis and wheel joint members will be maintained in that adjusted (indexed) angular position. Significantly, in the joint structure of FIGS. 4–6, as the joint members are indexed, the detent pad 30 moves axially along the pivot axis 24, relative to the member 20, but the wheel joint member 20 does not move axially relative to the chassis joint member 18. Such structure is significant where space, tolerances, etc. require that the joint members themselves not shift axially relative to each other.

The chassis and wheel joint members 18, 20 are preferably formed as hollow, plastic members, to minimize the weight and the cost of material forming the members. Also, each joint member actually comprises a pair of plastic sections which are joined together. Thus, in FIGS. 1–6, the chassis joint member 18 comprises plastic sections 18D, 18E which can be held together (through pin and boss connections not shown) to form a hollow joint member. The wheel joint member 20 is also formed by a pair of plastic sections 20D, 20E which combine to form the major portion of the wheel joint member, and the detent pad member 30 is keyed to one of the plastic sections to complete the wheel joint member. As seen from FIG. 2, the wheel joint member 20 includes an integral plastic shaft 20F and a metal wheel axle 44 is partly supported therein. The wheel axle 44 rotatably supports a plastic sleeve 46A forming part of a plastic wheel 46. Thus, the wheel 46 is rotatably supported by the wheel joint member 20 for rotation about the axis 26 defined by the wheel axle 44.

The chassis joint member 18 is supported from the chassis 14 by structure enabling the chassis joint member 18 to pivot about the pivot axis 22, and to be adjustably retained in discrete angular positions relative to the chassis 14. The chassis 14 has a pair of integral housing parts 51, which are U-shaped near their bottoms, and each of which supports a plastic differential member 50 extending across the width of the chassis 14. Each differential member 50 has a central section in the shape of a cross (see FIG. 2A) with a pair of horizontal walls 50A, 50B (FIG. 2) and a pair of vertical walls (50E). Each U-shaped housing part 51 has a slot 51A for supporting one of the horizontal walls 50A of the differential. Each U-shaped housing part 51 also has a flange 51B for supporting the other horizontal wall 50B of the differential member 50. The chassis 14 includes a pair of integral resilient snaps 14A which snap over and hold the horizontal walls 50B of the differential members against the flanges 51B of the housing parts 51. During assembly of the toy vehicle, the horizontal walls 50A of the differential are inserted in the slots 51A in the U-shaped housing part 51, and the resilient snaps 14A of the chassis 14 hold the horizontal walls 50B of the differential against the flanges 51B of the U-shaped housing parts. The vehicles body 12 includes integral retaining ribs, shown schematically at 12A. After the chassis 14 is connected with the differential members 50, in the manner described above, the vehicle body is connected with the chassis, and the retaining ribs 12A surround vertical walls 50E of the differentials 50 and, along with the slots 51A and the flaps 14A, hold the differentials 50 securely in place in the chassis 14.

Each end of each differential member 50 is pivotally connected to a chassis joint member 18. Specifically, each differential member 50 has disc 50C and a screw boss 50D at each of its outer ends (see FIGS. 2, 2A). Each disc 50C and screw boss 50D extends outside the U-shaped housing parts 51. Each screw boss 50D has a central axis which defines the pivot axis 22 for the associated chassis joint member.

The surface of the disc 50C associated with each screw boss 50D surrounds and extends normal to the pivot axis 22. The surface of the disc 50C carries recesses similar to the recesses 18C described above in connection with the joint structure of FIGS. 4–6. Further, the chassis joint member 18 associated with the pin 50C also carries a bias spring 53, a detent pad 54 with détents 56, all similar in structure and function to those in the joint structure of FIGS. 4–6. The foregoing joint structure is assembled and operates in the same way as described in connection with the joint structure of FIGS. 4–6 to enable the chassis joint member 14 to be adjustably retained in various angular positions relative to the chassis 14.

Thus, with the foregoing joint structure each wheel can be independently adjusted relative to the chassis 14 by pivoting the associated wheel joint member to an adjusted angular position relative to the chassis joint member and by pivoting the chassis joint member to an adjusted angular position relative to the chassis. Such structure enables independent adjustment of the orientation each of the wheels relative to the chassis as a compound function of the adjustment of the wheels relative to the chassis and the chassis joint member.

According to a further aspect of this invention, there are provided support members and stop members for the joint members to insure stability of the toy vehicle in its adjusted orientations. Specifically, along each side of the chassis 14 there are a pair of central support members 60, another pair of support members 62 aligned with the pivot axis 22 on the chassis joint member, and a central stop member 64. Further, the vehicle has a pair of additional support members 66 connected with the chassis at the front and rear of the vehicle.

The front and rear support members 66 span the width of the chassis. They are located so that when the chassis and wheel joint members are extended horizontally, as shown schematically in phantom in FIG. 3, one of the front or the rear stop members 66 will engage and support the wheel joint member just beyond (outward of) the pivot axis 24 between the wheel joint member 20 and the chassis joint member 18. Each of the central support members 60 on one side of the chassis spans the width of the joint members on that side of the chassis. Each of the central support members 60 is located to engage an associated pair of joint members 18, 20 at about the pivot axis 24 between the wheel and the chassis joint members, as shown in full lines in FIG. 3. Each of the support members 62 on one side of the chassis spans the width of the wheel joint members on that side of the chassis. Each of the support members 62 is located to engage an associated wheel joint member above the pivot axis 24. The central stop member 64 on each side of the chassis spans the width of the pairs of joint members on that side of the chassis. Each central stop member 64 is located to engage the joint structure associated with either the front or rear wheel on one side of the chassis, just beyond (outward of) the pivot axis 24 between the wheel and the chassis joint members. The purpose of each of the central stop members 64 is to prevent either of the joint structures on the associated side of the chassis from being shifted to an orientation in which the vehicle would be unstable, or in which a wheel 16 would engage with the chassis 14 in a way that would damage the wheel or the chassis, or interfere with the overall operation of the toy vehicle.

Figure 8:
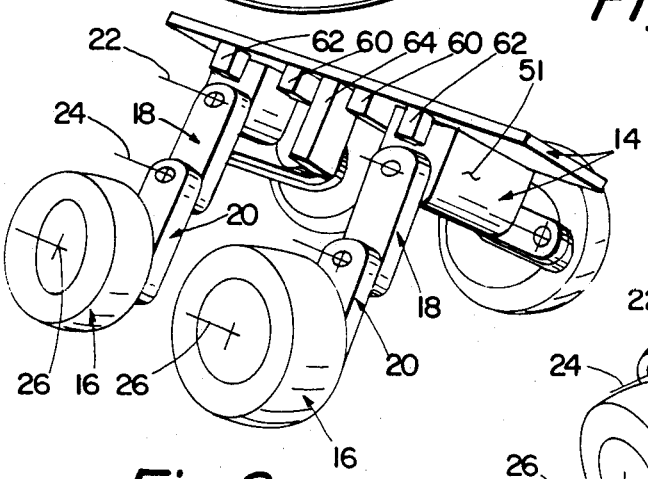
FIGS. 8 and 9 are schematic illustrations of the chassis, wheels and joint structure for a toy vehicle according to this invention showing two of the different relative orientations that the chassis and the wheels can be placed in using the principles of this invention.
Figure 9:
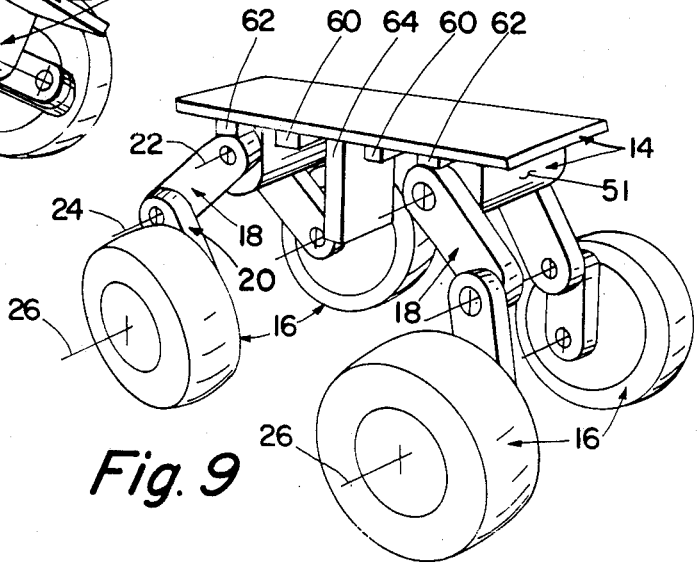

With the toy vehicle of the invention, there are a myriad of different positions the vehicle can be placed in. For example, as illustrated in FIG. 8, the joint structures on opposite sides of the vehicle can be adjustably retained in the relative positions shown, with the vehicle chassis 14 dramatically tilted to one side but still being retained in a stable position in which the vehicle can roll freely. The joint structures at the front and rear of the toy vehicle can also be adjustably retained in the relative positions illustrated schematically in FIG. 9, with the chassis 14 tilted forwardly or rearwardly. In fact, applicants have found that with the toy vehicle of this invention, there are approximately 52 different independent wheel adjustments relative to the chassis. The independent wheel adjustments, alone or in combination with the supports 60, 62 and/or the central stop 64, enable the chassis 14 and the wheels 16 to assume numerous stable orientations relative to each other. Moreover, it has been found that the toy vehicle can be maintained in many stable orientations with as few as three of its wheels in contact with a support surface. Thus, the joint structure for one rear wheel can be pivoted forward to the point where the joint structure engages the central stop 64 and causes the wheel to be held above a support surface, and the vehicle can still be placed in numerous stable positions with only three of the wheels remaining in contact with the support surface.

Figure 7:
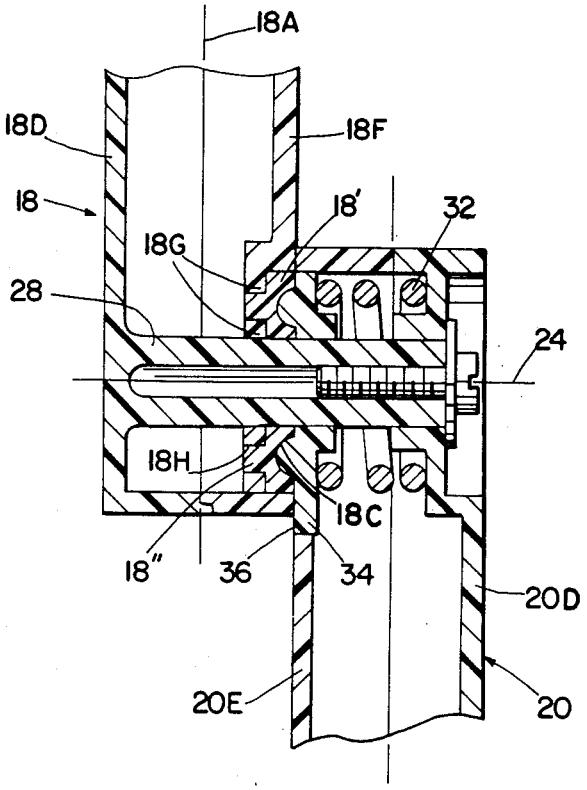
FIG. 7 is a sectional view of a modified joint structure for use in a toy vehicle according to this invention.

FIG. 7 illustrates a modified form of the joint structure for use in a toy vehicle according to the invention. The joint structure of FIG. 7 is generally similar to that of FIGS. 4–6, and for ease of description, the same numbers are used for the joint parts that ar the same in both joints. In the structure of FIG. 7, the chassis joint member 18 includes a separate recess pad member ' carrying the recesses 18C, and one of the plastic sections 18F of the chassis joint member is molded to form (i) a backing wall 18G for the recess pad member 18' and (ii) a series of slots 18H which engage fingers 18" on the recess pad member 18' in a key-and-slot connection, thereby to resist relative movement between the recess pad member 18' and the plastic section 18F. The use of separate pad members forming either or both of the detent or recess pad members enables either or both of those members to be formed from plastics with additional wear-resistant materials, if that is desired. For example, the plastic sections of the joint members can be formed of a high impact ABS (Acrylo Butadiene Styrene) of a type commonly used in plastic toys (For example, an ABS-type T1000 plastic sold by Borg-Warner Chemicals, Inc., International Center, Parkersburg, W. Va., 26101). Such ABS plastic would also form the chassis 14. The detent and/or recess pads can be formed of an acetal plastic (for example, an acetal plastic sold by E. I. DuPont de Nemours and Company, Dept. PPD, Barley Mill Plaza, P-18-1168, Wilmington, Del. 19890, under the name or mark "Delrin 500", or an acetal plastic sold by The Celanese Plastics Co., 26 Main St., Chatham, N.J. 07928, under the name or mark "Celcon M90") which has good wear resistance under repeated relative movement of the joint members.

Accordingly, the present invention provides a toy vehicle with the unique ability to be adjustably retained in numerous orientations, and to retain stability in those orientations.

Moreover, it will be clear to those of ordinary skill that the concepts of this invention can be used to provide numerous types of toy vehicle structures. For example, while a preferred version of a toy vehicle according to the invention comprises a chassis and a body portion that are joined together, it will be clear that the chassis and body may be integrally formed as a single element. Thus, in this application, "chassis" is used in a broad sense, and is intended to encompass any type of frame or body structure which a set of wheels can be connected to. Also, reference to a "joint member", a "joint structure" or a "joint means" being pivotal to selected positions "relative to" the chassis encompasses relative pivotal movement between the chassis and the joint member, joint structure or joint means, regardless of whether the joint member, joint structure or joint means is connected directly or indirectly with the chassis. Moreover, the concept of a "joint means" or a "joint structure", as used in the following claims is intended to encompass one or more joint members having the additional characteristics defined in the claims.

Attached are photographs A-D showing prototype toy vehicles constructed according to the principles of this invention, or portions thereof.

We claim:

1. A toy vehicle comprising a chassis and at least three wheels connected with said chassis and adapted to support said chassis for rolling movement along a surface; a separate joint structure connecting each of said three wheels with said chassis; the joint structure associated with each wheel comprising a wheel joint means for rotatably supporting the wheel and a chassis joint means for connecting said wheel joint means with said chassis; said chassis joint means including at least one chassis joint member supported for pivotal movement to discrete angular positions relative to the chassis; first detent means for adjustably retaining and indexing the chassis joint member in the discrete angular positions; said wheel joint means including at least one wheel joint member being supported for pivotal movement to discrete angular positions relative to the chassis joint means; second detent means for adjustably retaining and indexing the wheel joint member in the discrete angular positions, support means on the chassis separate from the joint structures adapted to engage each joint structure in at least two angular orientations to limit the range of pivotal movement of the chassis joint member associated with the joint structure and to stabilize the chassis joint member in those angular orientations in such a manner as to allow the wheel associated with the chassis joint member to roll along a surface with the chassis joint member oriented in either of said two angular orientations defined by the support means, the first detent means associated with each of the chassis joint members being disposed to adjustably retain the chassis joint member in at least two discrete additional angular orientations disposed between the limits of pivotal movement defined for the chassis joint members by the support means, said chassis extending from a first end to a second end; the separate joint structures supporting their associated wheels for independent adjustment relative to said chassis and relative to each other; the separate joint structures enabling the chassis to be adjustably retained and placed in a plurality of discrete stable angular orientations including discrete angular orientations in which the chassis is tilted toward the first end, the second end, and in opposite directions transverse to the first and second ends; the joint structure enabling the wheels to roll along the surface with the chassis adjustably retained in each of its discrete stable angular orientations.

2. A toy vehicle as defined in claim 1 wherein said support means of s chassis is further adapted to engage the wheel joint member in at least two orientations to limit the range of pivotal movement of the wheel joint member stabilize the wheel joint member in those angular orientations in such a man allow the wheel associated with the wheel joint member to roll along the sur the wheel joint member oriented in either of the two angular positions define support means, and the second detent means associated with each of the wheel members is disposed to adjustably retain the wheel joint member in at least angular orientations between the limits defined for the wheel joint member b support means.

3. A toy vehicle as set forth in claim 2, wherein said chassis and when joint members have parallel longitudinally extending axes, said chassis join having a portion supported by said chassis for pivotal movement relative to about a first pivot axis extending normal to said longitudinal ax®s, and said member having another portion which supports said wheel joint member in a ma enables relative pivotal movement of said wheel joint member about a second pivot axis extending parallel to said first pivot axis.

4. A toy vehicle as defined in claim 2 wherein said toy vehicle comprise at least a pair of front wheels and a pair of rear wheels connected with said adapted to support said chassis for rolling movement along the surface such said front and rear wheels is connected with said chassis for independent ad relative to said chassis and relative to each other.

5. A toy vehicle as defined in claim 3 wherein said toy vehicle comprises at least a pair of front wheels and a pair of rear wheels connected with said adapted to support said chassis for rolling movement along the surface such said front and rear wheels is connected with said chassis for independent ad relative to said chassis and relative to each other.

6. A toy vehicle comprising a chassis and at least three wheels connected with said chassis and adapted to support said chassis for rolling movement along a surface; a separate joint structure connecting each of said three wheels with said chassis, the joint structure associated with each wheel comprising a wheel joint means for rotatably supporting the wheel and a chassis joint means for connecting said wheel joint means with said chassis; said chassis joint means including at least one chassis joint member supported for pivotal movement to discrete angular positions relative to the chassis; firs detent means for adjustably retaining and indexing the chassis joint member in the discrete angular positions; said wheel joint means including at least one wheel joint member being supported for pivotal movement to discrete angular positions relative to the chassis joint means; second detent means for adjustably retaining and indexing the wheel joint member in the discrete angular positions; support means on the chassis separate from the joint structure adapted to engage each of the joint structures in at least two angular orientations to limit the range of pivotal movement of the chassis joint member associated with the joint structure and to stabilize the chassis joint member in those angular orientations in such a manner as to allow the wheel associated with the chassis joint member to roll along a surface with the chassis joint member oriented in either of the two angular orientations; the wheel joint member associated with each chassis joint member having a predetermined range of angular movement when the chassis joint member is in either of said two angular orientations; the second detent means associated with each of the wheel joint members being disposed to adjustably retain the associated wheel joint member in at least two discrete angular orientations between the limits of said predetermined range of angular movement for the wheel joint member; said chassis extending from a first end to a second end; the separate joint structures supporting their associated wheels for independent adjustment relative to said chassis and relative to each other; the separate joint structures enabling the chassis to be adjustably retained and placed in a plurality of discrete stable angular orientations including discrete angular orientations in which the chassis is tilted toward the first end, the second end, and in opposite directions transverse to the first and second ends; and the joint structures enabling the wheels to roll along the surface with the chassis adjustably retained in each of its discrete stable angular orientations.

7. A toy vehicle as defined in claim 6 wherein said support means of said chassis is further adapted to engage the wheel joint member in at least two angular orientations to limit the range of pivotal movement of the wheel joint member and to stabilize the wheel joint member in those angular orientations in such a manner as to allow the wheel associated with the wheel joint member to roll along the surface with the wheel joint member oriented in either of the two angular positions defined by the support means, and the second detent means associated with each of the wheel joint members is disposed to adjustably retain the wheel joint member in at least two discrete angular orientations between the limits defined for the wheel joint member by the support means.

8. A toy vehicle as et forth in claim 7, wherein said chassis and wheel joint members have parallel longitudinally extending axes, said chassis joint member having a portion supported by said chassis for pivotal movement relative to said chassis about a first pivot axis extending normal to said longitudinal axes, and said chassis joint member having another portion which supports said wheel joint member in a manner that enables relative pivotal movement of said wheel joint member about a second pivot axis extending parallel to said first pivot axis.

* * * * *

UNITED STATES PATENT AND TRADEMARK OFFICE

CERTIFICATE OF CORRECTION

PATENT NO. : 4,822,316

DATED : April 18, 1989

INVENTOR(S) : Ralph E. Shaffer, Edward G. Chanter, Randy J. Randleman, Robert H. Yeager It is certified that error appears in the above-identified patent and that said Letters Patent is hereby corrected as shown below:

Column 7, line 11, please change "ar" to --are--.

Column 7, line 13, please change "'" to --18'--.

Column 8, line 48, please change "s" to --said--.

Column 8, line 49, before "orientation" insert --angular--.

Column 8, line 51 before "stabilize" insert --and to--.

Column 8, line 52 please change "man" to --manner as to--.

Column 8, line 53, please change "sur" to --surface with--.

Column 8, line 55, before "support" insert --by the--.

Column 8, line 58, before "angular" insert --two discrete--.

Column 8, line 59, please change "b" to --by the--.

Column 8, line 62, please change "when" to --wheel--.

UNITED STATES PATENT AND TRADEMARK OFFICE

CERTIFICATE OF CORRECTION

PATENT NO. : 4,822,316

DATED : April 18, 1989

INVENTOR(S) : Ralph E. Shaffer, Edward G. Chanter, Randy J. Randleman, Robert H. Yeager It is certified that error appears in the above-identified patent and that said Letters Patent is hereby corrected as shown below:

Column 8, line 63, change "join" to --joint member--.

Column 8, line 65, before "about" insert --said chassis--.

Column 8, line 66, change "axes" to --axes--; before "member" insert --chassis joint--.

Column 8, line 67 change "ma" to --manner that--.

Column 9, line 4, change "comprise" to --comprises--.

Column 9, line 5, before "adapted" insert --chassis and--.

Column 9, line 7, before "said" insert --that each of--.

Column 9, line 8, change "ad" to --adjustment--.

Column 9, line 12, before "adapted" insert --chassis and--.

Column 9, line 14, before "said" insert --that each of--.

UNITED STATES PATENT AND TRADEMARK OFFICE

CERTIFICATE OF CORRECTION

PATENT NO. : 4,822,316

DATED : April 18, 1989

INVENTOR(S) : Ralph E. Shaffer, Edward G. Chanter, Randy J. Randleman, Robert H. Yeager It is certified that error appears in the above-identified patent and that said Letters Patent is hereby corrected as shown below:

Column 9, line 15, change "ad" to --adjustment--.

Column 9, line 21, change "," to ";".

Column 9, line 27, change "firs" to --first--.

Column 10, line 35, change "et" to --set--.

Signed and Sealed this

Sixth Day of March, 1990

*Attest:*

JEFFREY M. SAMUELS

*Attesting Officer*

*Acting Commissioner of Patents and Trademarks*